US006390322B1

(12) United States Patent
Shin

(10) Patent No.: US 6,390,322 B1
(45) Date of Patent: May 21, 2002

(54) EASY-OPEN CAN

(76) Inventor: Eui-Seung Shin, 400-13, Gung-dong, Yusung-ku, Taejon (KR)

( * ) Notice: Subject to any disclaimer, the term of this patent is extended or adjusted under 35 U.S.C. 154(b) by 0 days.

(21) Appl. No.: 09/715,368

(22) Filed: Nov. 17, 2000

Related U.S. Application Data

(63) Continuation of application No. PCT/KR00/01037, filed on Sep. 9, 2000.

(30) Foreign Application Priority Data

Aug. 26, 2000 (KR) ..... 2000-49836

(51) Int. Cl.[7] ..... B65D 17/28
(52) U.S. Cl. ..... 220/268
(58) Field of Search ..... 220/265, 266, 220/268, 270, 712, 713, 906

(56) References Cited

U.S. PATENT DOCUMENTS 3,779,417 A * 12/1973 Klein ..... 220/268
4,078,693 A * 3/1978 Asbury ..... 220/268
4,465,203 A 8/1984 Lambert ..... 220/268
4,723,684 A 2/1988 Lambert et al. ..... 220/268
4,784,283 A 11/1988 Cantu ..... 220/269
5,147,057 A * 9/1992 Marshall et al. ..... 220/268
5,535,911 A * 7/1996 Cortez ..... 220/268
6,253,946 B1 * 7/2001 Makinen ..... 220/268

* cited by examiner

*Primary Examiner*—Nathan J. Newhouse
(74) *Attorney, Agent, or Firm*—Paul A. Lesko; Thompson Coburn LLP

(57) ABSTRACT

The present invention relates to an easy-open can of aluminum or iron for storing beverage therein (high or low carbonated beverage), which comprises an easy-to-open stopper for a beverage can. The characteristic feature of the present invention is that, in a can formed of a body and a lid at the top, the lid has a protrusion, that is, an elevated part of a certain shape to prevent depression; a stopper formed inside the protrusion to open at need; a pressure surface which is connected with the risen surface of the protrusion at either one side, in a body, and slants gradually the lower as it approaches the center of the protrusion finally to join the stopper; a first incision groove, formed between the protrusion minus the pressure surface and the stopper, to cut at a pressure from outside; a first bending section, starting at the pressure surface to extend to one end of the stopper; a bending groove formed at the first bending section made to bend at one end when the pressure surface is pressed downward; and a second bending section, which bends when one end of the stopper is bent by the bending groove.

12 Claims, 13 Drawing Sheets

EASY-OPEN CAN

This application is a continuation of PCT/KR00/01037 filed on Sep. 9, 2000.

BACKGROUND OF THE INVENTION

1. Field of the Invention

The present invention relates to a beverage can of aluminum or iron for storing beverage therein (high or low carbonated beverage), which comprises an easy-to-open stopper used to discharge the beverage to the outside.

2. Description of the Related Art

Conventional beverage cans in wide use consist, as publicly known, of a body whose top is open and a lid which is fixed on the top of the body to keep the drink sealed up inside; wherein, the stopper is made in the form of slit grooves on the lid which latter is fixed on the top of the body to keep the drink tightly sealed up inside, and the stopper is cut open along the incision grooves when external pressure is applied, the opening of the stopper being carried out by lifting with fingers the tab fixed by a hinge on the top of the beverage can to serve as a lever, that is, when the tab is lifted upwards the part on the converse side across the fulcrum presses the stopper to make it fall downward, being cut along the incision grooves, thus an opening is provided for passage of the drink.

However, in the above structure, the tab and the lid making use of the principle of a lever are formed in close contact with each other and, therefore, a user often has to insert his or her finger nail between lid and tab to lift the latter. Sometimes a fingernail breaks. When the nails are cut short, it proves practically impossible to open a can. If a user has to open several beverage cans in repetition, his or her fingernail may become strained, even wounded. Indeed, it is problematic to say the least to open several cans at a time.

Although the tab used to open a beverage can is fixed onto the lid with a hinge, it has to be lowered again for the drink to be taken, once the can is opened, the part of the hinge bends and is apt to break easily.

The tab, breaking away, sometimes at the inadvertency of a user sinks to the bottom of the drink, which is unhygienic. Otherwise, broken tabs, not sinking to the bottom, are simply thrown away by users who hardly bother to keep them for separate collection for recycling. This adds to environmental problems. Collectors of discarded cans for recycling would not care for separate collection of can tabs heedlessly thrown away everywhere.

And for the tab fixed onto the lid to slit open the can, it uses the principle of a lever. Fixing of a tab invariably requires use of more material stuffs, which adds to the costs and an extra step of work of fixing the tab with a hinge.

SUMMARY OF THE INVENTION

The present invention was devised to solve these problems. It is an invention intended to provide a beverage can, which can be opened, with no tab formed upon the lid.

The present invention is to provide a beverage can, whose stopper can easily be opened only with a little external pressure of a finger.

The features of the easy-open can according to the present invention, intended to achieve such objectives as described above, are that the can in relation to having a body and a lid fixed on its top comprises as follows:

a protrusion for preventing depression, formed in a given shape on the top of the lid;

a stopper, which, formed inside the protrusion for preventing depression, opens;

a pressure surface, which, joining the elevated surface of the protrusion for preventing depression at either one side and slants lower as it approaches the center of the protrusion for preventing depression to connect with the stopper;

a first incision groove, which, formed between the protrusion for preventing depression, minus the pressure surface, and the stopper, is to cut slit at external pressure applied to the pressure surface;

a first bending section, which bends from the pressure surface to extend to an end of the stopper;

a bending groove, which is formed on the first bending section and bends an end of the stopper, when the pressure surface is pressed; and a second bending section, which bends when an end of the stopper bends along the bending groove; while, the protrusion for preventing depression, formed in a given shape on the top of the lid, is rendered higher in the part where it is connected with the pressure surface and lower in the converse part;

the protrusion for preventing depression is formed in a projecting circle in the part where its height is lower;

a second incision groove is formed in a given shape in addition between the first bending section, which bends under outside pressure and the protrusion for preventing depression;

one or more additional incision grooves, which is incised under external pressure are formed between the protrusion for preventing depression and the stopper;

one or more buffer grooves are formed on the stopper, which is connected with the protrusion for preventing depression, bordering on the first slitting section;

the first incision groove is formed on the corners of the end of the protrusion for preventing depression, the end of which is elevated from where the height of the protrusion is the lower;

the corner, formed on the first incision groove, is one or more in number;

a number of reinforcement protrusions are formed above the pressure surface, which applies external pressure to the first incision groove;

the first bending section, which extends from the pressure surface to an end of the stopper, is formed in the shape of a protrusion;

the first bending section extends further to a corner of the first incision groove; and, the first incision groove, which is formed between the stopper and the protrusion for preventing depression, is characteristically formed downwards from a corner to the central area and in an upward curse from the central area to the end part.

DETAILED DESCRIPTION OF THE PREFERRED EMBODIMENT

Below, the preferable embodiments of the open-easy beverage can according to the present invention are described in detail, making references to the drawings when desirable.

Figure 3:
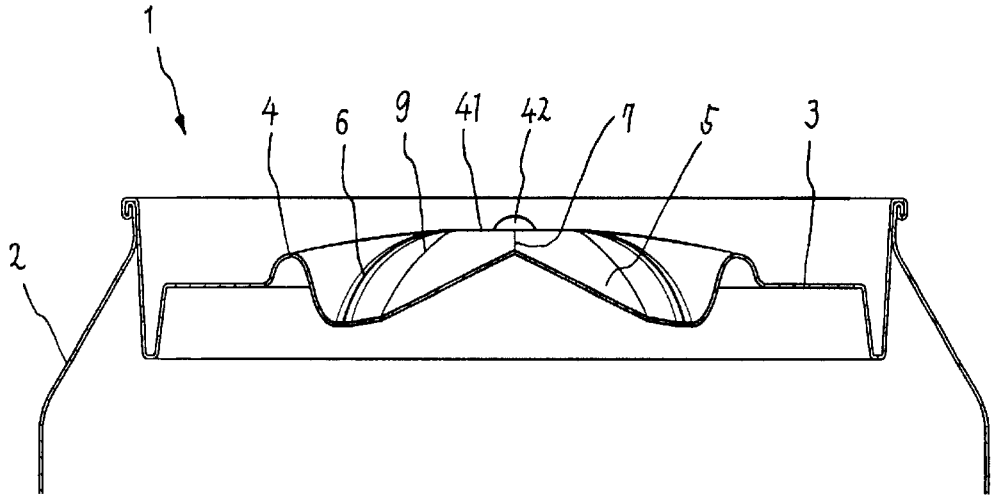
FIG. 3 is a sectional view of FIG. 1 along the A—A line.

In an example of the easy-open beverage can of the present invention, the beverage can 1 comprises a body 2 and a lid 3, as is shown in FIG. 3.

On the top of the lid 3 is formed a protrusion for preventing depression 4 rising upwards to prevent the lid 3 from untoward depression at external pressure.

Figure 1:
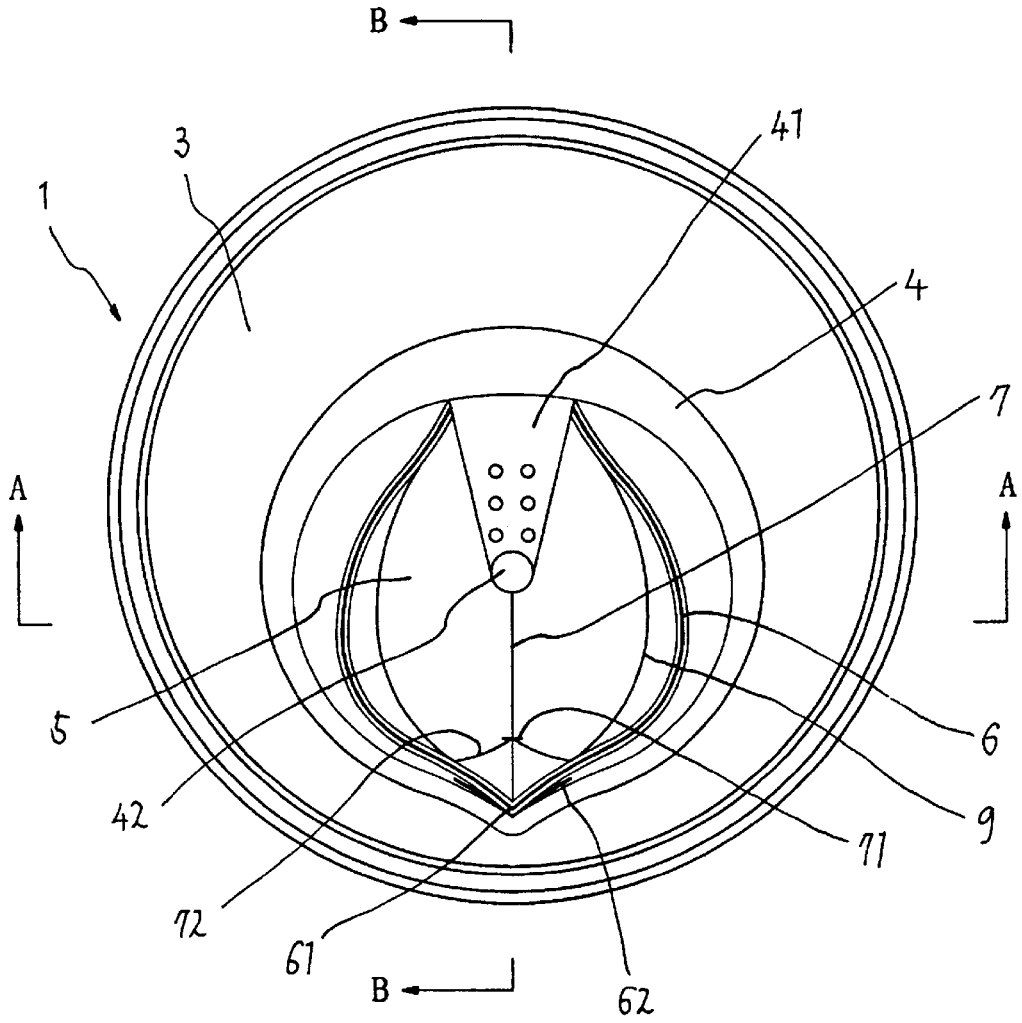
FIG. 1 is a plane view of the present invention to illustrate an example of its embodiment in summary.
Figure 2:
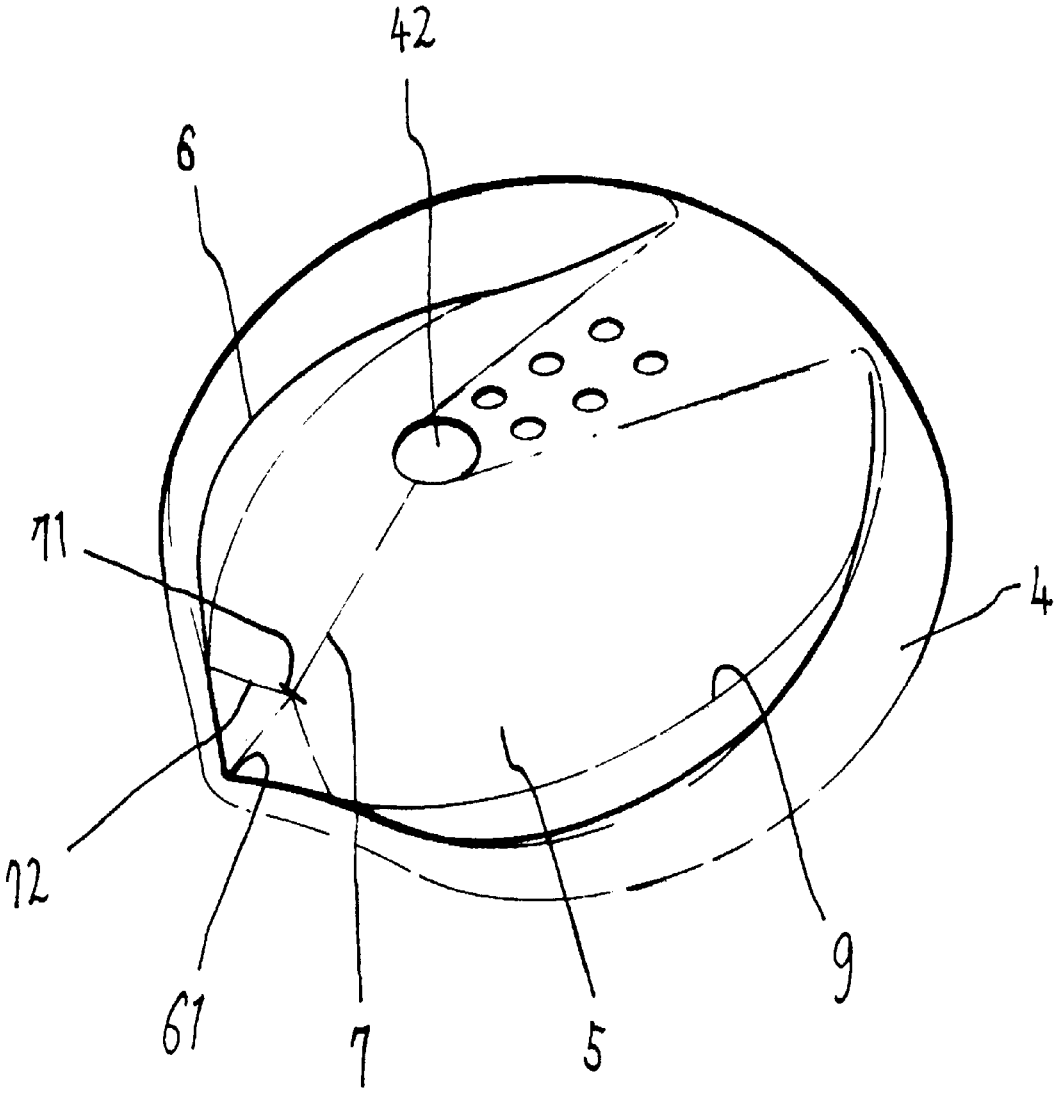
FIG. 2 is a perspective view of a means of discharging the content of the can.

As shown in FIG. 1, the protrusion for preventing depression 4, formed to prevent the lid 3 from untoward depression at external pressure, is preferably formed in a circle with one side protruding, but can also be formed in an ellipse or polygon.

Figure 4:
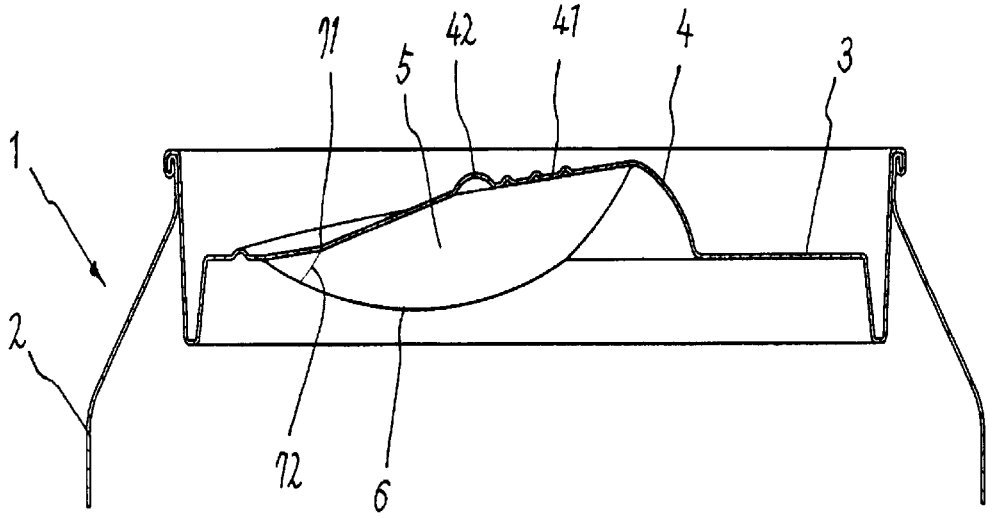
FIG. 4 is a sectional view of FIG. 1 along the B—B line.

The protrusion for preventing depression 4, in the shape as described above, is most preferably formed, as is shown in FIG. 4, lower than the ends of the lid 3, so that it may be kept free of untoward impact, even when external pressure is applied to the lid 3.

The protrusion for preventing depression 4, formed in a circle with one side protruding, is so made that the height of the protruding part is lower and the converse part is higher.

In the part of the protrusion for preventing depression 4, where the protrusion is the higher, a pressure surface 41 is formed in a body in a given manner.

The pressure surface 41, formed in a body with the higher part of the protrusion for preventing depression 4, is formed in a slant which becomes lower as the nearer it approaches the center of the protrusion 4.

On the top of the pressure surface 41, a number of smaller reinforcement protrusions 42 are formed so that when pressure is applied to the pressure surface 41 with a finger, the crumpling or collapse of the pressure surface 41 may be prevented.

The reinforcement protrusions 42 are preferably formed in a number of circular protrusions, but can also be formed in a number of varied shapes, as are shown in FIGS. 12 through 17.

The pressure surface 41, formed in connection with the part of the protrusion for preventing depression 4, where its height is the higher, is formed in a body with a stopper 5, formed in a certain shape inside the protrusion for preventing depression 4.

Between the stopper 5 and the protrusion for preventing depression 4 is formed a first incision groove 6, dug in a certain depth, dividing the lid 5 and the protrusion for preventing depression 4.

The first incision groove 6, marking off the protrusion for preventing depression 4 and the lid 5, is formed, as is shown in FIG. 1, along the inside girth of the protrusion for preventing depression 4, excluding the pressure surface 41.

The first incision groove 6, formed between the protrusion for preventing depression 4 and the lid 5, is preferably dug in depth ½~⅔ the thickness of the beverage can 1, so that when the pressure surface 41 is pressed down, the stopper 5, which is formed in the body with the pressure surface 41, may slit open the first incision groove 6 and easily collapse, but it can also be dug either deeper or shallower as necessary, provided that it is in such a depth as to easily slit open at external pressure.

The first incision groove 6 between the protrusion for preventing depression 4 and the stopper 5 forms a sharp corner 61, as shown in FIG. 1, on the risen part of the protrusion for preventing depression 4.

Figure 11:
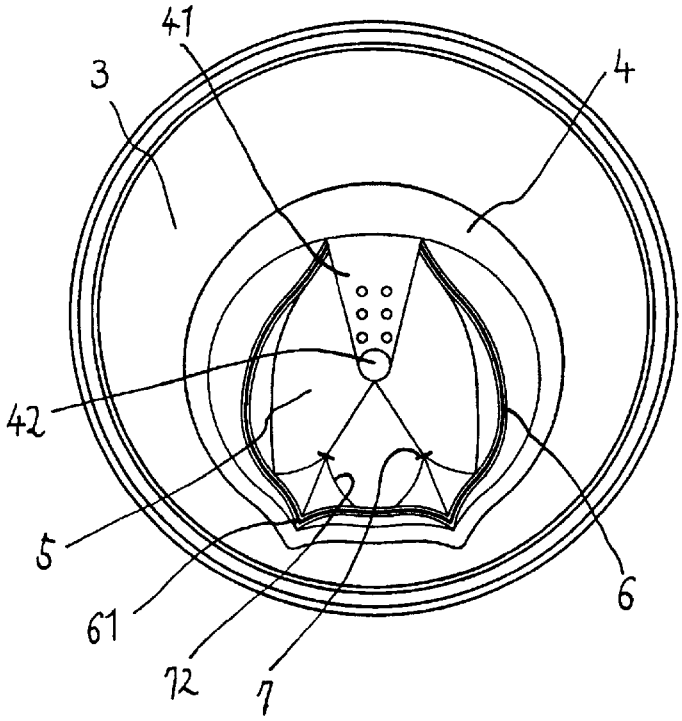
FIG. 11 is a plain view outlining to illustrate another embodiment example.
Figure 12:
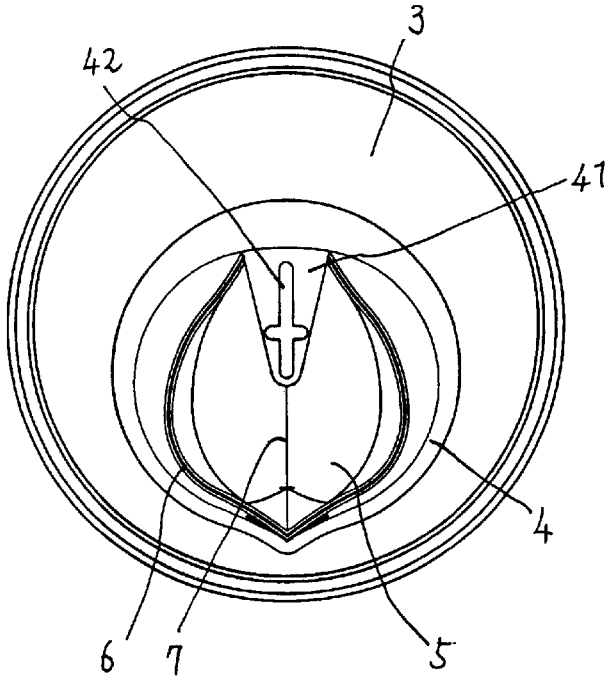
FIG. 12 is an outline illustration of Example 1 of a reinforcement protrusion.
Figure 13:
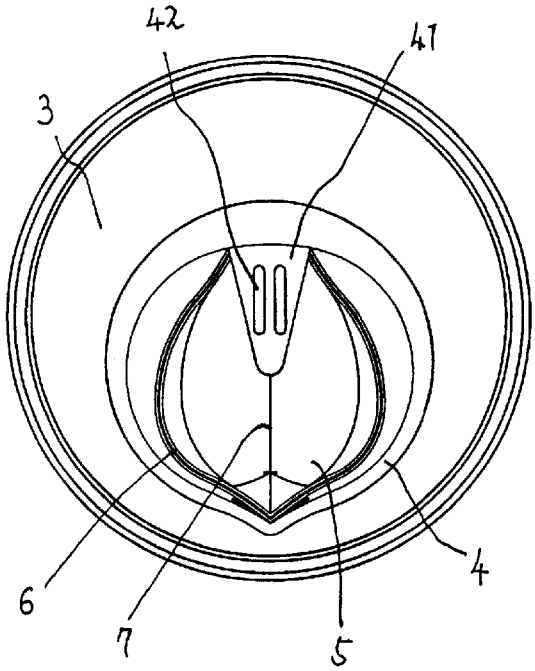
FIG. 13 is an outline illustration of Example 2 of the reinforcement protrusion.
Figure 14:
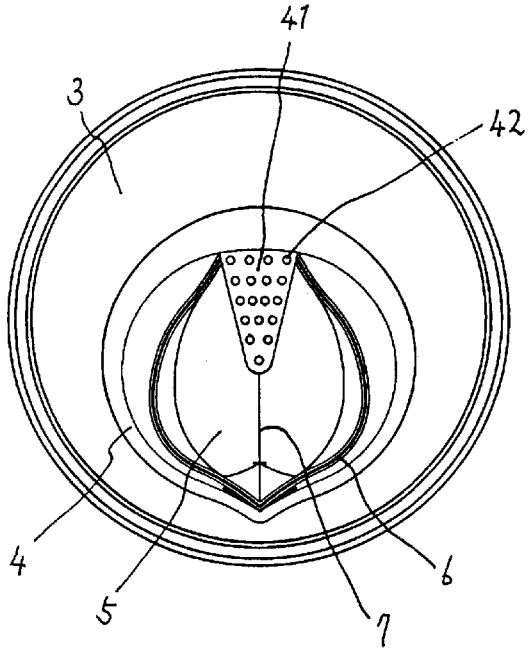
FIG. 14 is an outline illustration of Example 3 of the reinforcement protrusion.
Figure 15:
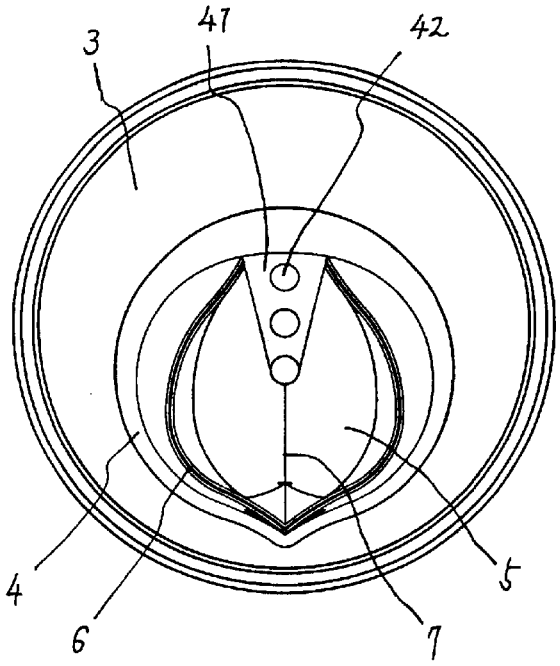
FIG. 15 is an outline illustration of Example 4 of the reinforcement protrusion.
Figure 16:
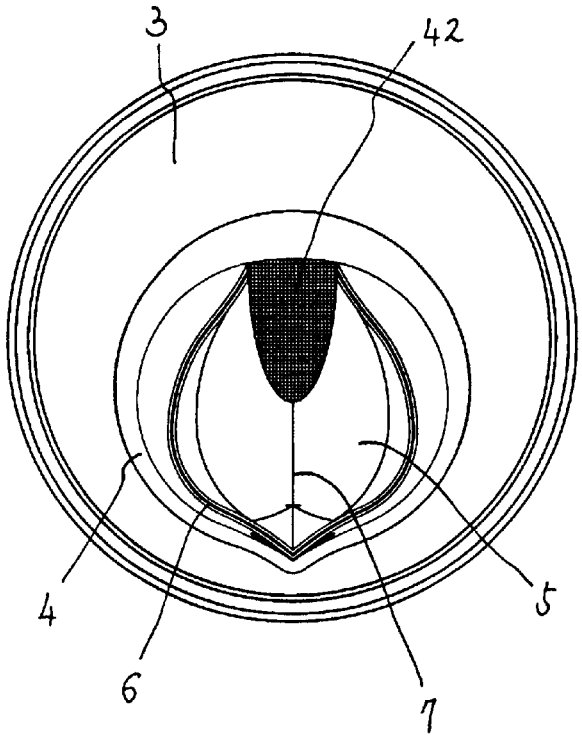
FIG. 16 is an outline illustration of Example 5 of the reinforcement protrusion.
Figure 17:
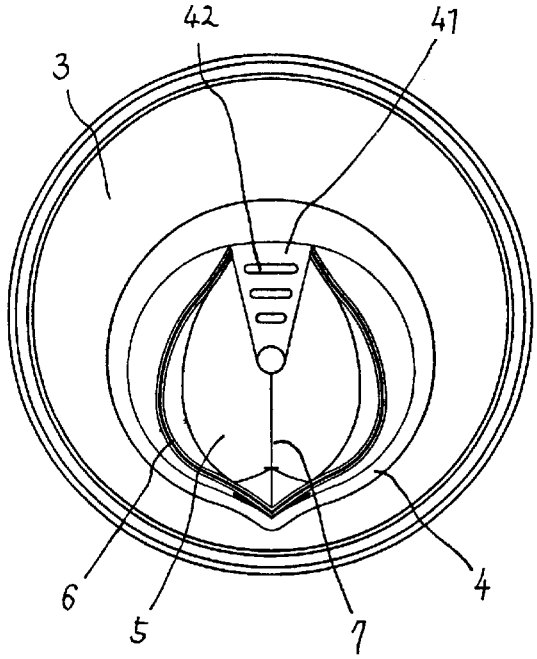
FIG. 17 is an outline illustration of Example 6 of the reinforcement protrusion.
Figure 18:
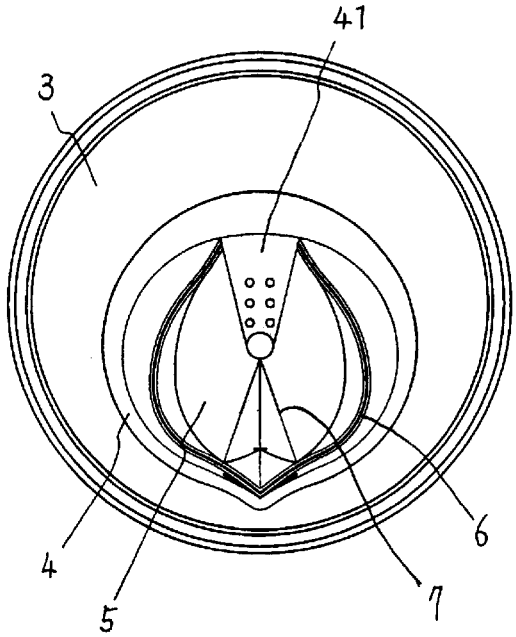
FIG. 18 is an outline illustration of Example 1 of a first bending section.
Figure 19:
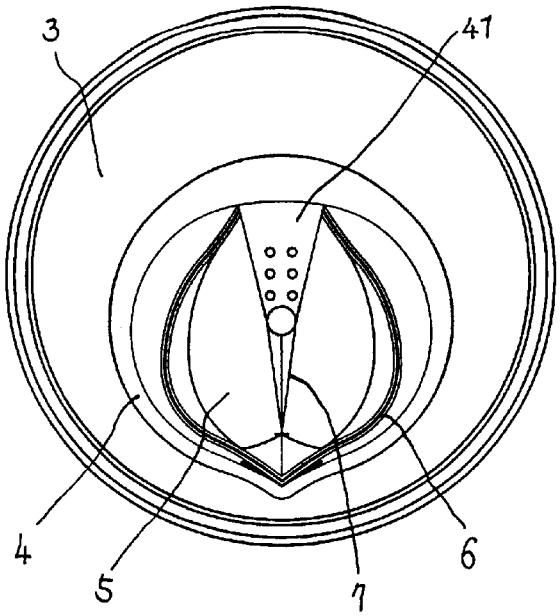
FIG. 19 is an outline illustration of Example 2 of the first bending section.
Figure 20:
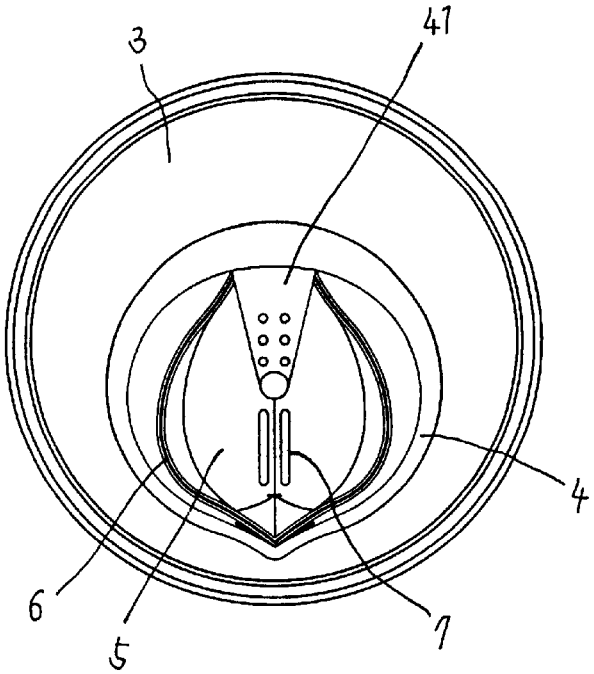
FIG. 20 is an outline illustration of Example 3 of the first bending section.
Figure 21:
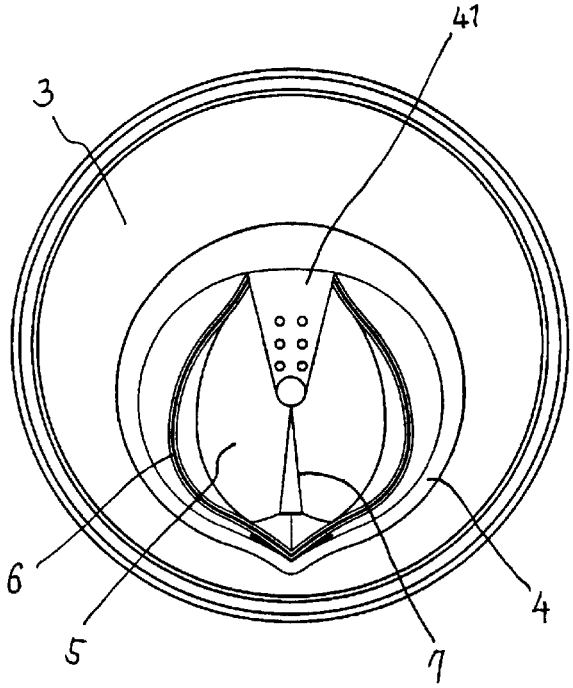
FIG. 21 is an outline illustration of Example 4 of the first bending section.
Figure 22:
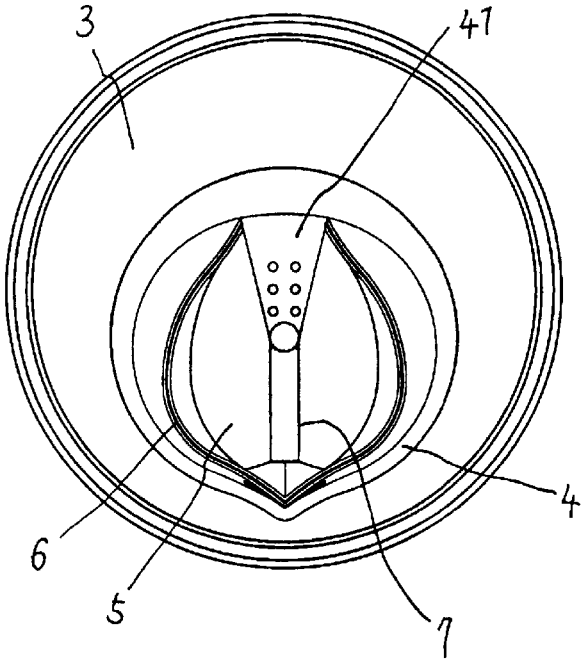
FIG. 22 is an outline illustration of Example 5 of the first bending section.
Figure 23:
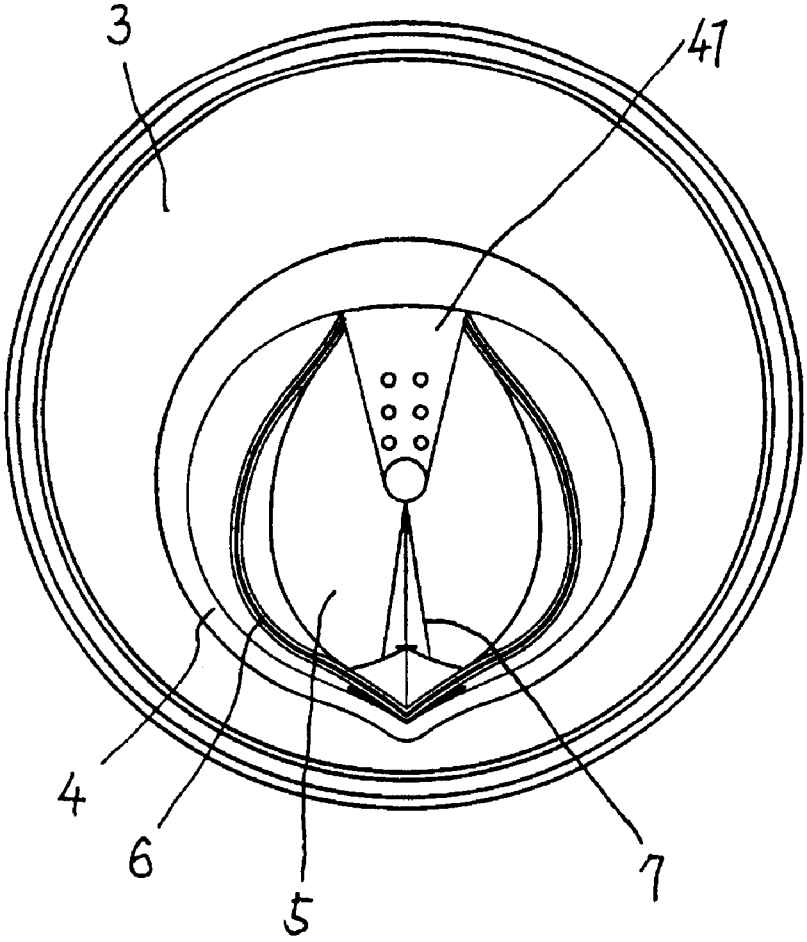
FIG. 23 is an outline illustration of Example 6 of the first bending section.

The corner 61 can be formed in a number more than one, as shown in FIG. 11, or in fact several, but just one or two are the appropriate number.

A first bending section 7 is formed, as is shown in FIG. 1, extending from the first incision groove 6 formed between the protrusion for preventing depression 4 and the lid 5, to one side of the pressure surface 41.

The first bending section 7, formed from the pressure surface 41 to the first incision groove 6, is so formed as to intersect the corner 61, formed in an extension from the first incision groove 6, and it is preferably so formed that the force, relayed to the pressure surface 41 when the pressure surface 41 is pressed down with a finger, can be relayed along the first bending section 7 to the corner 61 of the first incision groove 6.

The first bending section 7, which is to relay the external pressure applied to the pressure surface 41 to the corner 61 of the first incision groove 6 formed between the protrusion for preventing depression 4 and the stopper 5, may have two or more projections close together in a symmetry with the first bending section 7 as the center, as shown in FIGS. 18 through 23.

On one side of the first bending section 7, which extends from the pressure surface 41 to the corner 61 of the first incision groove 6, a second bending section 72 is formed in a form of a triangle in symmetry, intersecting with the first bending section 7 as a center at a certain point of the first bending section 7, as is shown in FIG. 1.

The second bending section 72, which is formed to extend from a certain point of the first bending section 7 to the first incision groove 6, makes the force relayed to the first bending section 7 spread to the second bending section 72.

Figure 7:
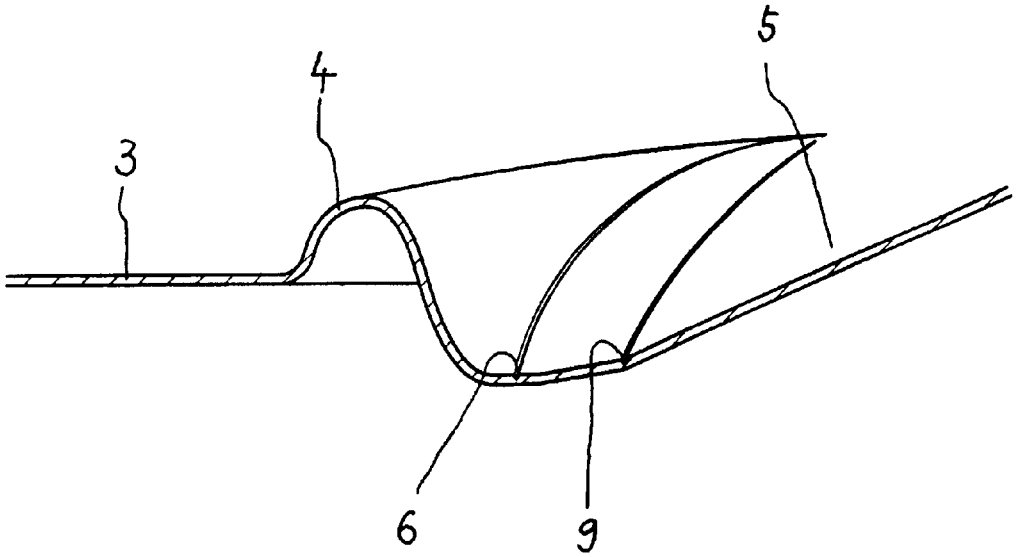
FIG. 7 is a sectional view, with the main parts enlarged, roughly to illustrate an example of an incision groove and a buffer groove in the present invention.
Figure 8:
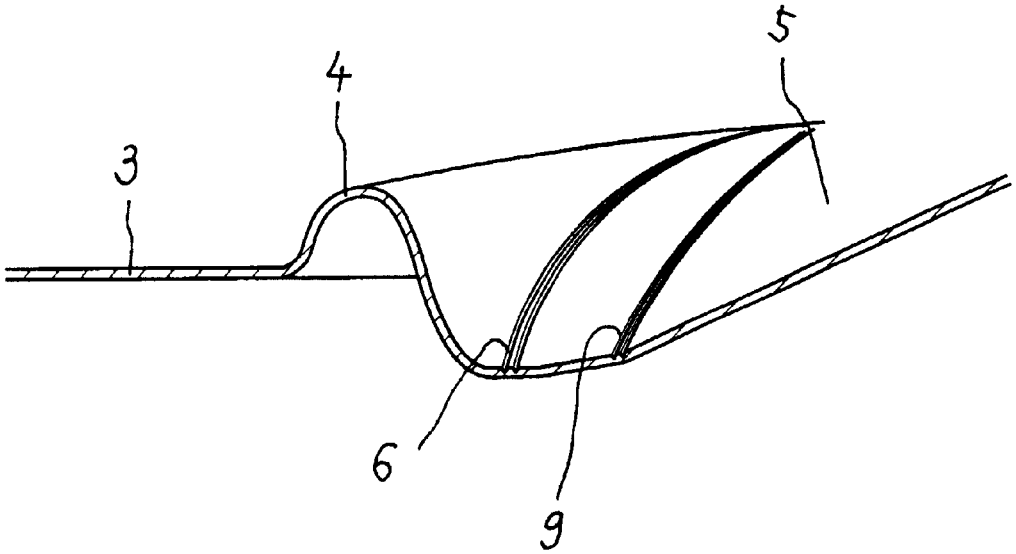
FIG. 8 is a sectional view, with the main parts enlarged, roughly to illustrate another example of an incision groove and a buffer groove.

At the spot where the first bending section 7 intersects the second bending section 72, a first bending groove 71 is formed and, as shown in FIGS. 7 and 8, so that the first bending section 7 may bend to a certain angle.

The bending groove 71 is so formed that it is supported to the triangular second bending section 72, before the force relayed by the pressure surface 41 to the first bending section 7 is relayed to the corner 61 of the first incision groove 6, and that the part of the corner 61 of the first slit groove 6 may be lifted up from the bending groove 71 under the lever principle to relay the force.

At the corner 61 of the first incision groove 6, which slits open under the force relayed from the pressure surface 41 a second incision groove 62 is formed at a certain length.

The second incision groove 62 slits open together with the first slitting grove 6, and it is preferable to form the second incision groove 62 in close contact with the corner 61 of the first 6 that, when the first incision groove 6 fails to slit open, the second incision groove 62 may slit open first to be followed by the first incision groove 6.

Figure 10:
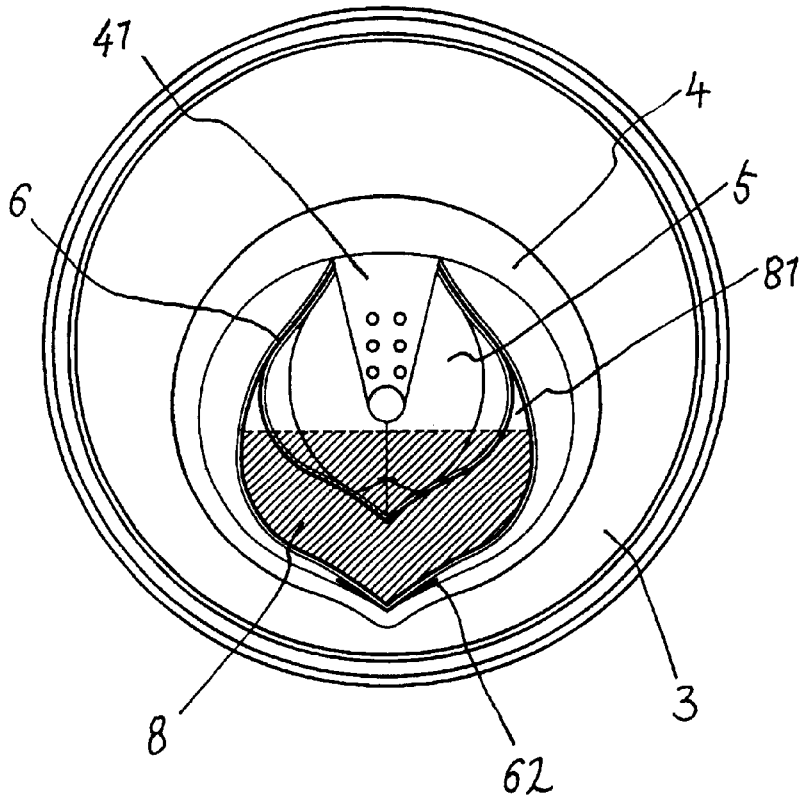
FIG. 10 is a plain view to show the content of a can when it is open by the opening device.

An opening 8, which opens, as is shown in FIG. 10, by the depression of the stopper 5 as the first incision groove 6 slits, is formed to open in the shape of a "U," and the drink is drawn from the corner 61 of the first incision groove 6, while at both ends of the first incision groove 6 where it is connected to the pressure surface 41 air-inlets 81 are automatically provided as the first incision groove 6 opens to let air into the body 2 of the can 1, to prevent the draft of the drink from making gurgling noise.

Figure 9:
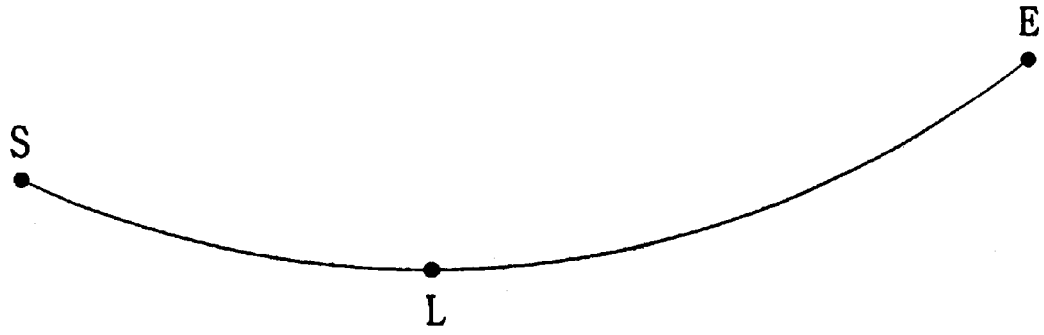
FIG. 9 is a surface view to show the order in which an incision groove slits.

The first incision groove 6 between the protrusion for preventing depression 4 and the stopper 5 is formed in a incision groove, as shown in FIG. 9, in a downward slant, if the beverage can 1 is viewed lengthwise, starting at the corner 61, the center of the first incision groove 6, where the slit-opening begins, as the start point (S), to extend to the lowest point (L) of the first incision groove 6, but from this lowest point (L) to the ending point (E), formed close by the pressure surface 41 connected with the protrusion for preventing depression (E) in a upward slant, this the first incision groove 6 being in a symmetry with the first bending section 7 as the center.

Because the first incision groove 6 is formed, as above, in a downward slant from the corner 61, the center of the first incision groove 6, toward the lowest point (L), and in an upward slant from there, and because the incision groove 6 is in a curve in the direction in which the force is applied, when the stopper 5 falls as the pressure surface 41 is pressed down with a finger and thus the first incision groove 6 slits open, the finger will never get hurt by the first incision groove 6 even if it goes down in the direction of the fall of the stopper 5.

The first incision groove 6, which is formed in a curve, can be formed in one or two or even more in number, as can be seen in FIGS. 7 and 8.

On the top of the stopper 5, which is depressed to open under the pressure applied to the pressure surface 41 of the first incision groove 6, a buffer groove 9 is formed.

The buffer groove 9 is preferably formed to absorb untoward pressure which may perchance be applied to the lid 3 of the beverage can 1 so that the first incision groove 6 and the second 62 must not slit open under such pressure but will only when certain pressure is applied to the pressure surface 41.

The buffer groove 9 on the top of the stopper 5 is formed in one or two or more in number, as can be seen in FIGS. 7 and 8, and is preferably formed with a depth ⅓~½ the thickness of the beverage can 1.

To open a can of the structure of the present invention, as given above, the user has just to press down, with some force, the pressure surface 41, formed in connection with the pressure-preventing protrusion 4 on the top of the lid 3 of the can 1.

Because the protrusion for preventing depression 4 is formed in an protrusion of a certain height, the lid 3 itself does not get depressed thanks to the protrusion 4 even when the pressure surface 41 is pressed down.

When force is applied to the pressure surface 41 by pressure of a finger upon it, the force is relayed along the first bending section 7 of the stopper 5, which bending section is formed from the pressure surface 41, to the corner 61 of the first incision groove 6.

Figure 5:
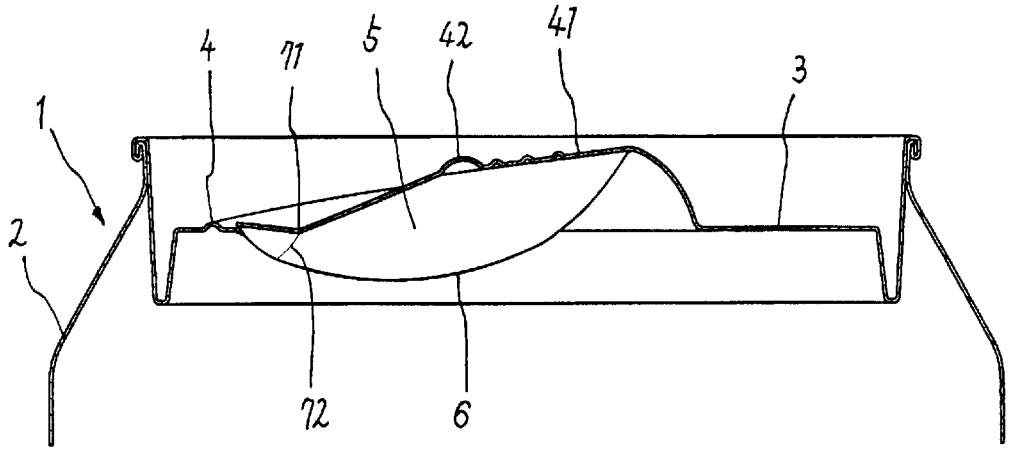
FIG. 5 is a sectional view outlining the state of the upper portion of a means of discharging the beverage while it is pressed down.
Figure 6:
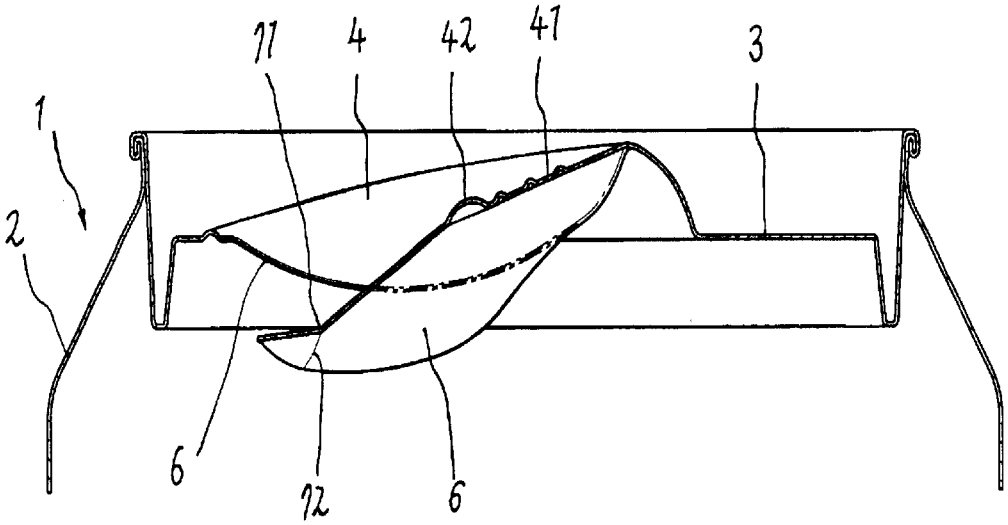
FIG. 6 is a sectional view of the means of discharging the content of the can when the stopper of the means is opened.

When the force applied to the pressure surface 41 is relayed along the first bending section 7, the force relayed from the bending groove 71 formed at a side of the first bending section 7 changes its direction to get relayed to the second bending section 72 connected with the first bending section 7, and thus the second bending section 72 bearing the pressure, the corner 61 of either the first incision groove 6 or the second incision groove 62 bends, starting at the bending groove 71, and goes upward, as has been shown in FIG. 5.

When the corner 61 of the first incision groove 6, as shown in FIG. 5, is pressed under external pressure, the bending groove 71 becomes supported by the second bending section and bent, and the corner 61 is lifted upward.

As the corner 61 of the first incision groove 6 formed at an end of the the stopper 5 around the bending groove 71 bends and goes upward, the corner 61 of the first incision groove 6 slits open.

If the force is continuously applied, when the corner 61 of the incision groove 6 is slit open, the first incision groove 6 goes on slitting open to where it is extended, starting from the corner 61.

Because the first incision groove 6 is formed, as is shown in FIG. 9, in a downward slant starting at the starting point (S) of the corner 61, where the slitting starts, to reach the lowest point (L), the slitting easily goes on along the first incision groove 6 to the lowest point (L), once it starts at the corner 61.

With that speed of slitting open downward from the corner 61 as the starting point the slitting open continues from the lowest point (L) upward to the ending point (E) where the first incision groove 6 ends, and the stopper 5 sinks below the lid 3, thus forming an opening 8 at the top of the lid 3.

Because the first incision groove 6 is formed in a downward curve of a groove from the starting point (S) to the ending point (E), the finger of a user applying force to the pressure surface 41 does not come into contact with the first incision groove 6, even when it goes down along with the stopper 5, which sinks in a body with the pressure surface 41, thanks to the protrusion for preventing depression 4 at a certain height and the first incision groove 6, whereby the finger does not get injured.

When the first incision groove 6 slits open under the pressure applied by the finger of a user and the stopper 5 sinks to form the opening 8, as is shown in FIG. 10, then it is possible to tip the beverage can 1 to draw its content through the opening 8.

When the can 1 is tipped for the content to flow through the opening 8, an air inlet 81 is formed on either end of the opening 8, which is formed in the shape of "U," and air flows in through these inlets 81 when the can 1 is tilted, rendering the air pressure equal in and out of the beverage can 1, and thus preventing the beverage can 1 from gurgling while the content flows out.

In the above, the best preferable embodiment of an easy-open beverage can according to the present invention has been described, but the present invention as a matter of course should not be confined to this embodiment alone but naturally covers all of its variables within the widest range of the Claims, the descriptions, and the drawings attached thereto.

Because in the present invention a separate opener is not used for opening a beverage can, nor does it require a finger or a finger nail to be forced into a small opening, but, instead, a can is opened just by pressure with a finger, it is no trouble to open a number of cans in repetition, nor is there any risk of injuring a finger nail.

In the present invention no separate opener is used and thus it follows that there is no risk of environmental problems arising from the breakaway or discard of countless openers. When collecting wastes, too, it is enough only to gather used cans, a 100% recycling being possible.

Due to the absence of a tab for opening a stopper on the lid of a beverage can, the present invention can provide savings in raw materials and reduction in the manufacturing process.

What is claimed is:

1. An easy-open can, having a body and a lid fixed onto the upper portion thereof, wherein said lid comprises:

(a) a protrusion for preventing depression, protruding in a certain shape at the upper surface thereof;

(b) a first incision groove along the inside girth of said protrusion for preventing depression;

(c) a stopper marked off from said protrusion for preventing depression by means of said first incision groove, wherein said stopper comprises:

(d) a pressure surface, extending in integration with said protrusion for preventing depression, which is a slanting surface lowering towards the inside of said protrusion for preventing depression;

(e) a first bending section, which extends in a slant of curvature from said pressure surface to said first incision groove;

(f) a bending groove, which is formed at a certain position of said first bending section, and (g) a second bending section, from said bending groove to said first incision groove, in symmetry with said first bending section as a center.

2. The easy-open can according to claim 1, comprising said protrusion for preventing depression, wherein the height of the portion thereof which joins said pressure surface is made higher, and the height of protrusion on the opposite side thereof is made lower.

3. The easy-open can according to claim 2, wherein the side, which has a lower height of protrusion on said protrusion for preventing depression, protrudes further outwards.

4. The easy-open can according to claim 1, which comprises two or more of said first incision grooves.

5. The easy-open can according to claim 1, wherein said stopper comprises one or more buffer grooves.

6. The easy-open can according to claim 1, wherein said first incision groove comprises a corner at a certain angle at the intersection of said first bending section.

7. The easy-open can according to claim 6, which comprises a second incision groove of a certain length near said corner.

8. The easy-open can according to claim 1, which comprises a multiple of reinforcement protrusions on the upper portion of said pressure surface.

9. The easy-open can according to claim 1, which comprises two or more of said first bending sections.

10. The easy-open can according to claim 9, which comprises one or more corners formed in extension from said first incision groove.

11. The easy-open can according to claim 1, which comprises protrusions, near said first bending section, in symmetry with said first bending section as a center.

12. The easy-open can according to claim 1, wherein said first incision groove, in symmetry with said first bending section as a center, extends in a downward slant from the intersection of said first bending section to the point of said first incision groove, and extends in curvature of an upward slant to the end of said first incision groove, where said protrusion for preventing depression and the pressure surface of said stopper are joined.

* * * * *